US010022838B2

(12) United States Patent
Akita et al.

(10) Patent No.: US 10,022,838 B2
(45) Date of Patent: Jul. 17, 2018

(54) CUTTING APPARATUS

(71) Applicant: DISCO CORPORATION, Tokyo (JP)

(72) Inventors: Soichiro Akita, Tokyo (JP); Satoshi Kiyokawa, Tokyo (JP)

(73) Assignee: DISCO Corporation, Tokyo (JP)

( * ) Notice: Subject to any disclaimer, the term of this patent is extended or adjusted under 35 U.S.C. 154(b) by 27 days.

(21) Appl. No.: 15/331,450

(22) Filed: Oct. 21, 2016

(65) Prior Publication Data

US 2017/0113322 A1 Apr. 27, 2017

(30) Foreign Application Priority Data

Oct. 21, 2015 (JP) ..... 2015-207468

(51) Int. Cl.
*B24B 53/12* (2006.01)
*B24B 49/12* (2006.01)
*B24B 53/08* (2006.01)

(52) U.S. Cl.
CPC ..... *B24B 53/12* (2013.01); *B24B 53/08* (2013.01)

(58) Field of Classification Search
CPC ..... B24B 53/12; B24B 53/08; B24B 49/12
USPC ..... 451/56, 72, 6, 443, 21; 125/13.01, 11.01
See application file for complete search history.

(56) References Cited

U.S. PATENT DOCUMENTS 4,559,919 A * 12/1985 Kushigian ..... B24B 53/08 125/11.03
4,897,964 A * 2/1990 Vetter ..... B24B 53/08 125/11.03
5,353,551 A * 10/1994 Nishida ..... B23D 59/001 451/5
6,761,615 B2 * 7/2004 Cohen ..... B23D 59/001 451/10
2001/0044256 A1 * 11/2001 Sekiya ..... B23D 59/002 451/5

FOREIGN PATENT DOCUMENTS

JP 2010-087122 4/2010

* cited by examiner

*Primary Examiner* — Robert Rose
(74) *Attorney, Agent, or Firm* — Greer Burns & Crain Ltd.

(57) ABSTRACT

Disclosed herein is a cutting apparatus including a moving unit for moving a spindle to position a cutting blade, a rotary dressing mechanism for rotating a dressing grindstone on a rotational shaft parallel to the spindle, and an optical sensor for detecting the position of the outer periphery of the dressing grindstone. The cutting blade is positioned with respect to the rotary dressing mechanism depending on the position, detected by the optical sensor, of the outer periphery of the dressing grindstone, and the cutting blade is dressed by cutting into the dressing grindstone by a predetermined cutting distance.

3 Claims, 5 Drawing Sheets

CUTTING APPARATUS

BACKGROUND OF THE INVENTION

Field of the Invention

The present invention relates to a cutting apparatus, and more particularly to a cutting apparatus provided with rotary dressing means.

Description of the Related Art

Cutting apparatus that cut a workpiece such as a wafer with a cutting blade rotating at a high speed are likely to suffer a problem in that as the cutting of the workpiece continues, the cutting blade has its tip end tapered off, and when the workpiece is continuously cut by the tapered-off tip end of the cutting blade, the shape accuracy of the side faces of device chips cut off the workpiece tends to be lowered. In order to prevent the problem from occurring, it is necessary to dress the cutting blade by having the tip end thereof cut into a dressing grindstone and worn thereby. The dressing process serves to true the cutting blade which is mounted off center on a spindle and also to sharpen the cutting blade which has been glazed or loaded by the cutting process.

The dressing process of the cutting blade needs to be carried out at appropriate times during the cutting process. Usually, after the workpiece has been removed from the chuck table, a dedicated dressing board is held under suction on the chuck table, and the cutting blade is dressed by the dressing board. However, since the steps of holding the dressing board under suction on the chuck table and removing the dressing board from the chuck table are very complex, it has been customary to provide an auxiliary chuck table dedicated for use with the dressing board in the vicinity of the chuck table (see Japanese Patent Laid-Open No. 2010-87122).

If the cutting apparatus has a highly hard cutting blade, then when the cutting blade is dressed by the dressing board held on the auxiliary chuck table dedicated for use with the dressing board, the amount of material cut off the dressing board by the cutting blade may not be sufficient. One solution is to use a rotary dressing device for dressing the cutting blade with a rotating dressing grindstone in order to increase the resistance with which to cut the rotating dressing grindstone.

SUMMARY OF THE INVENTION

The rotary dressing device makes it possible to wear even a hard cutting blade because the cutting blade cuts the rotating dressing grindstone in the dressing process. However, inasmuch as the dressing grindstone is also worn and has its diameter reduced during usage, the rotary dressing device is disadvantageous in that it is difficult to adjust the cutting distance by which the cutting blade is to cut into the rotating dressing grindstone.

It is therefore an object of the present invention to provide a cutting apparatus wherein a cutting blade can be positioned with respect to the outer periphery of a dressing grindstone for a desired cutting distance at all times.

In accordance with an aspect of the present invention, there is provided a cutting apparatus including a chuck table for holding a workpiece thereon, cutting means for cutting the workpiece held on the chuck table with a cutting blade mounted on a spindle, while supplying a cutting fluid to the cutting blade, moving means for moving the spindle to position the cutting blade, rotary dressing means for rotating a dressing grindstone on a rotational shaft parallel to the spindle, and an optical sensor for detecting the position of the outer periphery of the dressing grindstone. The cutting blade is positioned with respect to the rotary dressing means depending on the position, detected by the optical sensor, of the outer periphery of the dressing grindstone, and the cutting blade is dressed by cutting into the dressing grindstone by a predetermined cutting distance.

Preferably, the optical sensor is positioned to apply an inspection light beam emitted therefrom toward the rotational shaft of the dressing grindstone to the outer peripheral surface of the dressing grindstone. The cutting apparatus further includes calculating means for calculating the diameter of the dressing grindstone on the basis of light reflected from the outer peripheral surface of the dressing grindstone to which the inspection light beam is applied. The cutting blade is positioned with respect to the rotary dressing means on the basis of the diameter of the dressing grindstone which is calculated by the calculating means, and the cutting blade is dressed by cutting into the dressing grindstone by the predetermined cutting distance.

Preferably, the cutting apparatus further includes a casing housing the optical sensor therein, the casing having an opening for passing the inspection light beam emitted from the optical sensor therethrough, and air curtain forming means disposed near the opening. An air curtain formed by the air curtain forming means prevents debris and a cutting fluid from entering the casing through the opening and being applied to the optical sensor.

In the cutting apparatus according to the present invention, since the position of the outer periphery of the dressing grindstone is detected by the optical sensor and the diameter of the dressing grindstone is calculated on the basis of the detected position of the outer periphery of the dressing grindstone, the cutting blade can be positioned with respect to the outer periphery of the dressing grindstone for a desired cutting distance at all times.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
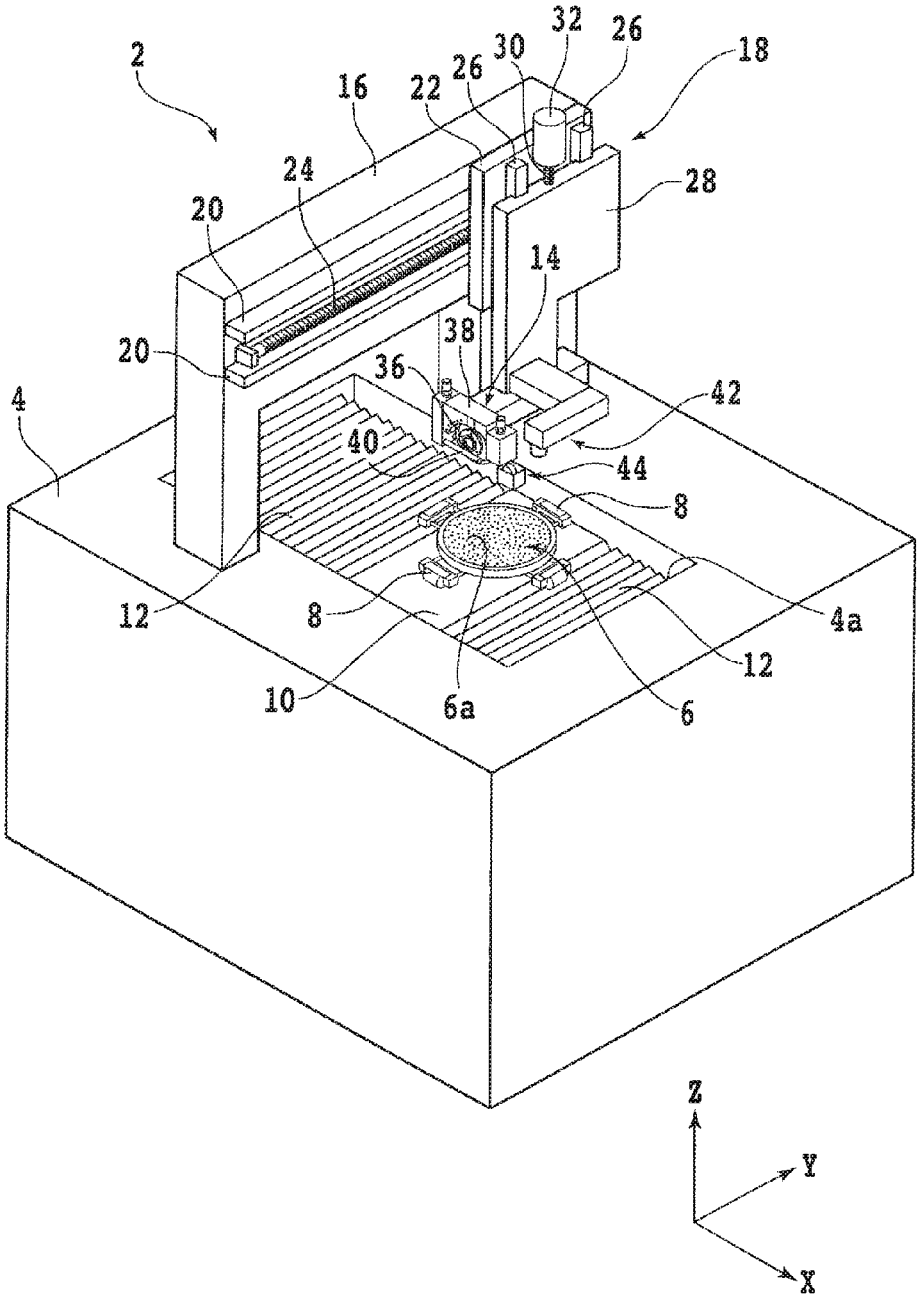
FIG. 1 is a perspective view of a cutting apparatus according to an embodiment of the present invention.

An embodiment of the present invention will hereinafter be described in detail below with reference to the accompanying drawings. FIG. 1 shows in perspective a cutting apparatus 2 according to the present embodiment. As shown in FIG. 1, the cutting apparatus 2 has a base 4 with a rectangular opening 4*a* defined therein which extends in an X-axis direction. The cutting apparatus 2 also has a chuck table 6 having a suction holder 6*a* made of porous ceramics or the like disposed in the opening 4*a*. The chuck table 6 is rotatable about its own axis and movable back and forth along the X-axis direction by an X-axis moving mechanism, not shown.

A plurality of clamps 8 for clamping an annular frame of a frame unit that supports a workpiece are disposed at spaced intervals on an outer peripheral portion of the chuck table 6. A water cover 10 is disposed around the chuck table 6, and a bellows 12 extends between and is coupled to the water cover 10 and the base 4. A portal-shaped support structure 16 that supports a cutting unit 14 is disposed on an upper surface of the base 4 across the opening 4*a*. A cutting unit moving mechanism 18 for moving the cutting unit 14 in Y-axis and Z-axis directions is mounted on an upper portion of a front surface of the support structure 16.

The cutting unit moving mechanism 18 includes a pair of Y-axis guide rails 20 fixed to the front surface of the support structure 16 and extending parallel to the Y-axis direction. The cutting unit moving mechanism 18 also includes a Y-axis movable plate 22 slidably riding on the Y-axis guide rails 20. A nut, not shown, is mounted on the reverse side of the Y-axis movable plate 22 and threaded over a Y-axis ball screw 24 rotatably mounted on the front surface of the support structure 16 and extending parallel to the Y-axis guide rails 20. A Y-axis stepping motor, not shown, is coupled to one end of the Y-axis ball screw 24. When the Y-axis stepping motor rotates the Y-axis ball screw 24 about its own axis, therefore, the Y-axis movable plate 22 moves in the Y-axis direction on and along the Y-axis guide rails 20.

The cutting unit moving mechanism 18 further includes a pair of Z-axis guide rails 26 fixed to the front surface of the Y-axis movable plate 22 and extending parallel to the Z-axis direction. The cutting unit moving mechanism 18 also includes a Z-axis movable plate 28 slidably riding on the Z-axis guide rails 26. A nut, not shown, is mounted on the reverse side of the Z-axis movable plate 28 and threaded over a Z-axis ball screw 30 rotatably mounted on the front surface of the Y-axis movable plate 22 and extending parallel to the Z-axis guide rails 26. A Z-axis stepping motor 32 is coupled to one end of the Z-axis ball screw 30. When the Z-axis stepping motor 32 rotates the Z-axis ball screw 30 about its own axis, therefore, the Z-axis movable plate 28 moves in the Z-axis direction on and along the Z-axis guide rails 26.

The cutting unit 14, which serves to cut a workpiece held on the chuck table 6, is mounted on a lower portion of the Z-axis movable plate 28. An image capturing unit 42 including a microscope and a camera for capturing an image of an upper surface of the workpiece on the chuck table 6 is disposed on the lower portion of the Z-axis movable plate 28 at a position adjacent to the cutting unit 14.

Figure 2:
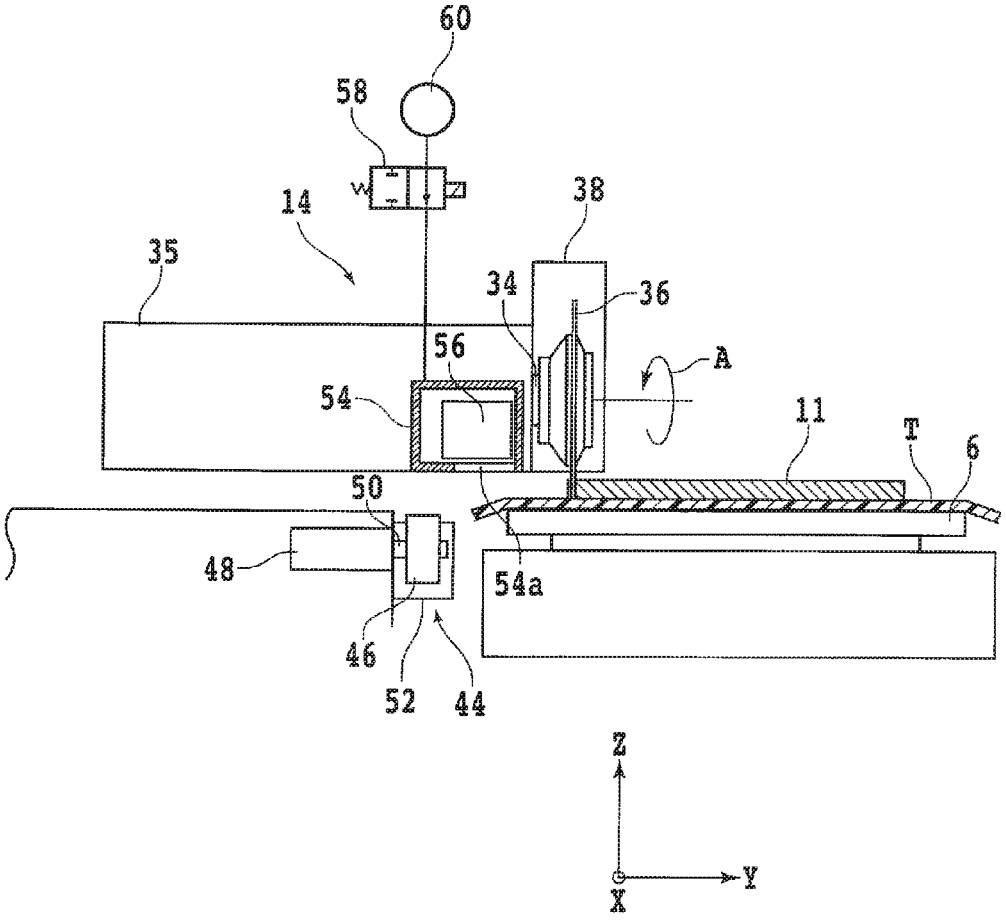
FIG. 2 is a fragmentary side elevational view, partly in cross section, of a central portion of the cutting apparatus while it is cutting a workpiece.

The cutting unit 14 includes a spindle 34, shown in FIG. 2, which can be rotated about its own axis by a motor, a cutting blade 36 mounted on the tip end of the spindle 34, a blade cover 38 covering an upper half of the cutting blade 36, and a pair of cutting fluid supply nozzles 40, one shown, mounted on the blade cover 38 and extending in the X-axis direction on both sides of the cutting blade 36.

When the Y-axis movable plate 22 is moved along the Y-axis direction by the cutting unit moving mechanism 18, the cutting unit 14 and the image capturing unit 42 are indexing-fed along the Y-axis direction. When the Z-axis movable plate 28 is moved along the Z-axis direction by the cutting unit moving mechanism 18, the cutting unit 14 and the image capturing unit 42 are moved vertically along the Z-axis direction.

Figure 3:
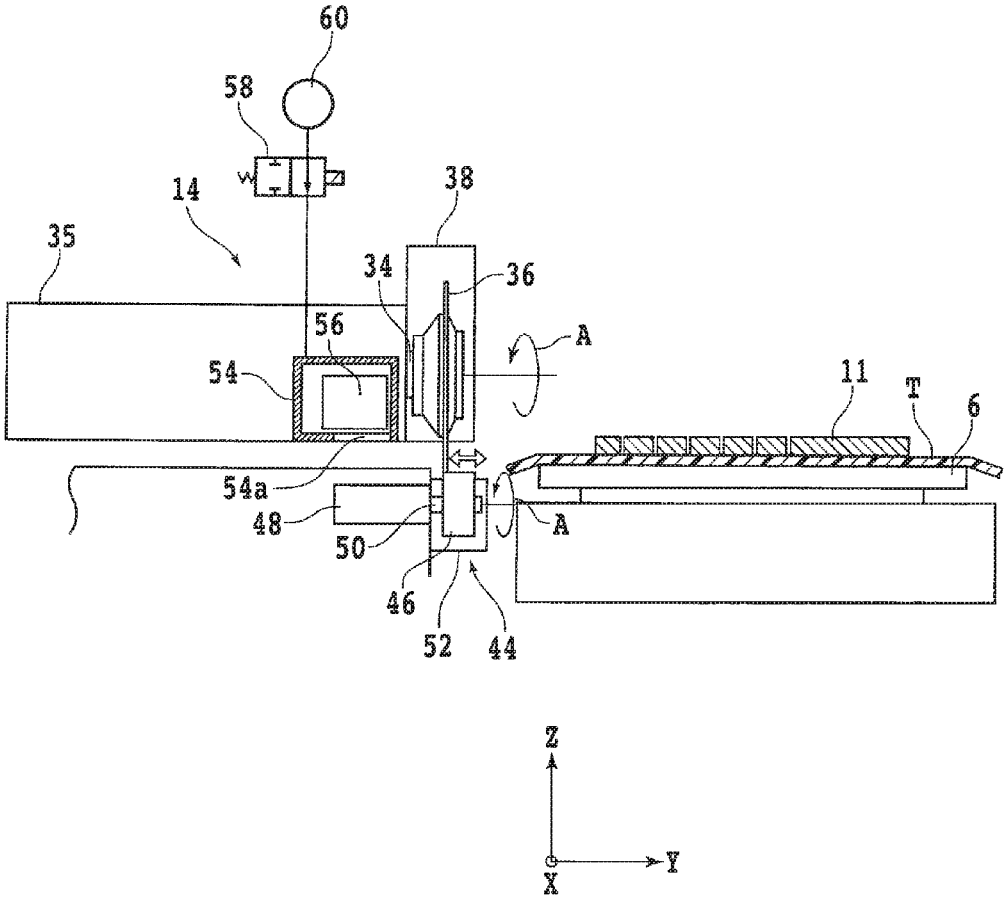
FIG. 3 is a fragmentary side elevational view, partly in cross section, of the central portion of the cutting apparatus while a rotary dressing grindstone is dressing a cutting blade.
Figure 4:
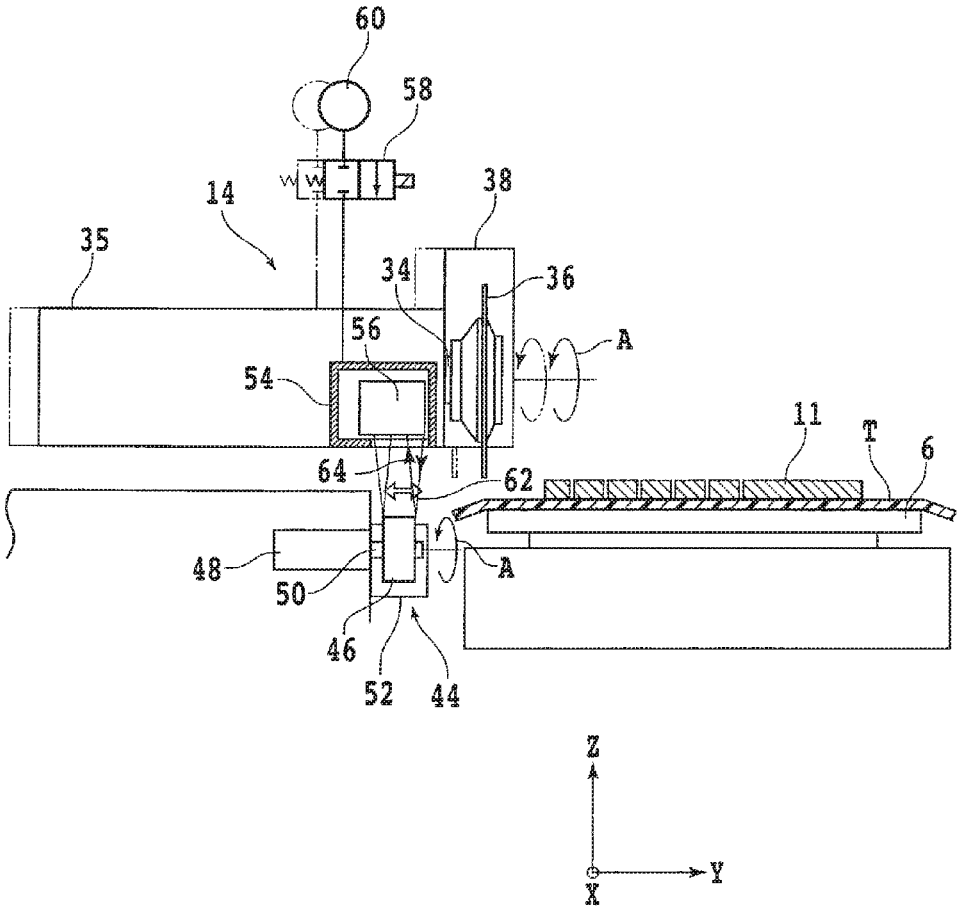
FIG. 4 is a fragmentary side elevational view, partly in cross section, of the central portion of the cutting apparatus while the position of the outer periphery of the rotary dressing grindstone is being detected.

According to the present embodiment, the cutting apparatus 2 has a rotary dressing device (rotary dressing means) 44 mounted on a side face of the base 4 and projecting into the opening 4*a*. As best shown in FIGS. 2 through 4, the rotary dressing device 44 includes a motor 48, a rotary dressing grindstone (dressing grindstone) 46 fixed to an output shaft 50 of the motor 48, and a cover 52 covering the rotary dressing grindstone 46.

The rotary dressing grindstone 46 is fabricated, for example, by mixing green carborundum (GC) abrasive grains of silicon carbide (SiC) with a resin bond of filler-containing phenolic resin, molding the mixture into a hollow cylindrical shape, and sintering the shaped mixture at a temperature in the range from approximately 600° C. to 700° C. Preferably, the rotary dressing grindstone 46 should be of a composition including 50% to 60% by weight of super abrasive grains and a phenolic resin including 45% to 35% by weight of a filler. The rotary dressing grindstone 46 according to the present embodiment has an outside diameter of 3 inches, a width of 1 inch, and an inside diameter of 0.5 inch. However, the rotary dressing grindstone 46 should not be limited to these dimensional numerical values.

Figure 5:
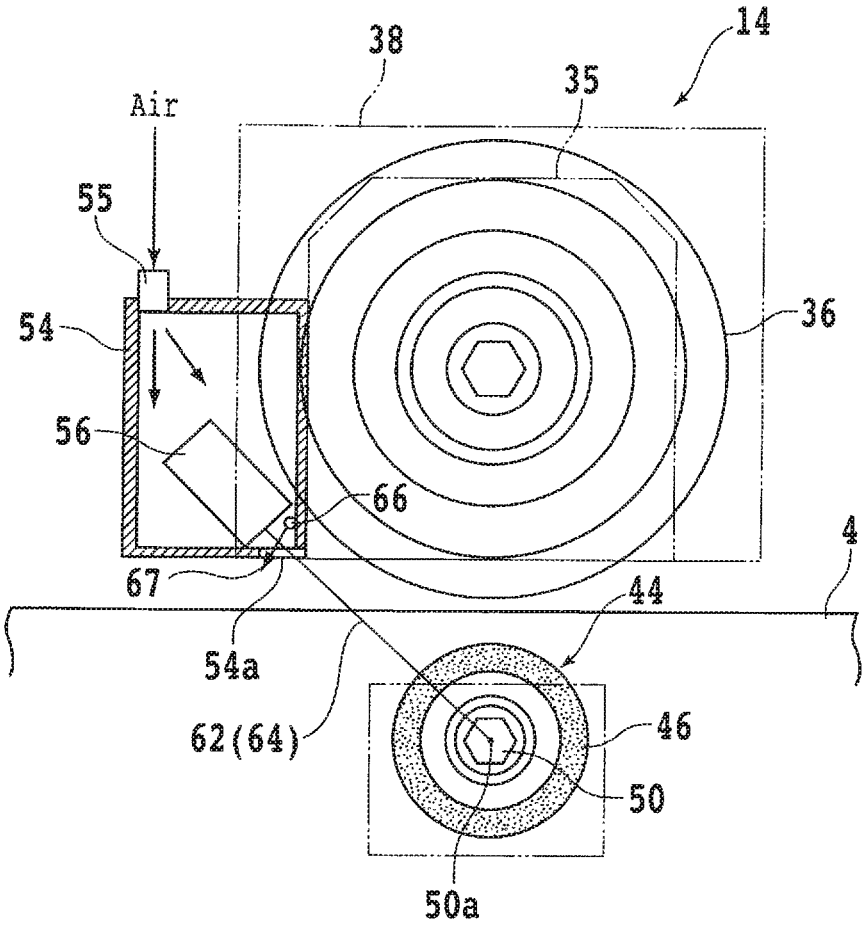
FIG. 5 is an enlarged fragmentary front elevational view, partly in cross section, of a cutting unit while the position of the outer periphery of the rotary dressing grindstone is being detected.

As best shown in FIG. 5, a sensor case 54 is mounted on a spindle housing 35 of the cutting unit 14, and houses an optical sensor 56 therein. The sensor case 54 has an opening 54*a* defined in a wall thereof. An inspection light beam 62 that is emitted from a light emitter of the optical sensor 56 passes through the opening 54*a* and is applied to an outer peripheral surface of the rotary dressing grindstone 46 from a direction perpendicular to the rotational shaft of the rotary dressing grindstone 46, i.e., the output shaft 50 of the motor 48. Specifically, the inspection light beam 62 that is emitted from the optical sensor 56 is directed toward the center (axial center) 50*a* of the rotational shaft 50 of the rotary dressing grindstone 46. The outer peripheral surface of the rotary dressing grindstone 46 diffusely reflects the applied inspection light beam 62 as reflected light 64, which is detected by a light detector of the optical sensor 56.

As shown in FIGS. 2 through 4, the sensor case 54 is connected to a compressed air source 60 through a solenoid-operated on-off valve 58. When the solenoid-operated on-off valve 58 is shifted to the open position shown in FIG. 2, compressed air from the compressed air source 60 is introduced through an air inlet port 55 defined in the sensor case 54 into the sensor case 54 and then discharged out of the sensor case 54 through the opening 54*a*, as shown in FIG. 5. Air curtain forming means 66, which is disposed in the sensor case 54 near the opening 54*a*, forms an air curtain 67 in and across the opening 54*a* to block debris cut from the workpiece and the cutting fluid from the cutting fluid nozzles 40 against entry through the opening 54*a* into the sensor case 54.

FIG. 2 shows, in fragmentary side elevation, partly in cross section, a central portion of the cutting apparatus 2 while it is operating in a cutting step to cut the workpiece, designated 11, held on the chuck table 6 with the cutting blade 36 that is rotating at a high speed in the direction indicated by the arrow A. In the cutting step, the cutting blade 36 rotating at the high speed (e.g., 30000 rpm) in the direction indicated by the arrow A is lowered to cut into the workpiece 11 and a dicing tape T between the workpiece 11 and the chuck table 6, while at the same time the chuck table 6 is processing-fed in the X-axis direction, thereby cutting the workpiece 11.

While the workpiece 11 is being cut, the solenoid-operated on-off valve 58 is shifted to the open position shown in FIG. 2, introducing compressed air from the compressed air source 60 through the air inlet port 55 into the sensor case 54. The introduced compressed air is discharged out of the sensor case 54 through the opening 54*a*. At the same time, the air curtain forming means 66 forms the air curtain 67 in and across the opening 54*a*, blocking debris and the cutting fluid against entry through the opening 54*a* into the sensor case 54 to thereby prevent the optical sensor 56 from being contaminated by debris and the cutting fluid.

As the workpiece 11 is continuously cut, the tip end of the cutting blade 36 is tapered off. When the workpiece 11 is continuously cut by the tapered-off tip end of the cutting blade 36, the shape accuracy of the side faces of device chips cut off the workpiece 11 tends to be lowered. In order to avoid this difficulty, it is necessary to periodically carry out an outside-diameter-correction dressing process for correcting the outer periphery of the cutting blade 36. In addition, since the cutting blade 36 is glazed or loaded to lower its cutting performance after continuous use, it is also necessary to periodically carry out a sharpening dressing process to sharpen the cutting blade 36.

For dressing the cutting blade 36, the cutting blade 36 is caused to cut a predetermined depth into the rotary dressing grindstone 46. Consequently, it is necessary to accurately recognize the height of the outermost periphery of the rotary dressing grindstone 46. Preferably, the diameter of the rotary dressing grindstone 46 is measured before the rotary dressing grindstone 46 dresses the cutting blade 36. Since the rotational shaft of the rotary dressing grindstone 46, i.e., the output shaft 50 of the motor 48, is disposed at a predetermined height, the height of the outermost periphery of the rotary dressing grindstone 46 is already known when the rotary dressing grindstone 46 is brand new. The known height of the outermost periphery of the rotary dressing grindstone 46 is stored in the memory of a controller of the cutting apparatus 2. The limit diameter, which represents the amount by which the rotary dressing grindstone 46 can be used, is established and also stored in the memory of the controller.

When the diameter of the rotary dressing grindstone 46 is periodically measured, as shown in FIGS. 4 and 5, the light emitter of the optical sensor 56 applies the inspection light beam 62 to the outer peripheral surface of the rotary dressing grindstone 46, and the light detector of the optical sensor 56 detects the diffusely reflected light 64 from the outer peripheral surface of the rotary dressing grindstone 46. The distance from the optical sensor 56 to the outer peripheral surface of the rotary dressing grindstone 46 can accurately be measured by measuring the time consumed after the light emitter of the optical sensor 56 has emitted the inspection light beam 62 until the light detector of the optical sensor 56 detects the diffusely reflected light 64 and also the position where the light detector of the optical sensor 56 detects the diffusely reflected light 64.

While the position of the outer peripheral surface of the rotary dressing grindstone 46 is being detected, the optical sensor 56 is moved in a widthwise direction, i.e., the Y-axis direction, while the rotary dressing grindstone 46 is being rotated at 10000 rpm, for example. In this manner, the position of the outer peripheral surface of the rotary dressing grindstone 46 is detected at a plurality of locations. The maximum one of the values measured at those locations is detected as the diameter of the rotary dressing grindstone 46. The height of the outermost periphery of the rotary dressing grindstone 46 is calculated from the detected diameter of the rotary dressing grindstone 46 by calculating means of the controller, and stored in the memory of the controller.

After the present height of the outermost periphery of the rotary dressing grindstone 46 has been detected, the cutting blade 36 starts being dressed. For dressing the cutting blade 36, the height by which the cutting blade 36 is to cut into the rotary dressing grindstone 46, i.e., a cutting distance, is set on the basis of the detected height of the outermost periphery of the rotary dressing grindstone 46. Then, while the cutting blade 36 is rotating at a high speed (e.g., 30000 rpm) in the direction indicated by the arrow A as shown in FIG. 3, the cutting blade 36 is caused to cut into the rotary dressing grindstone 46 which is being rotated at 10000 rpm in the direction indicated by the arrow A by the set cutting distance. The cutting blade 36 is now dressed by the rotary dressing grindstone 46 as the cutting blade 36 is moved in the Y-axis direction.

Inasmuch as the cutting blade 36 and the rotary dressing grindstone 46 are rotated both in the direction indicated by the arrow A, the cutting blade 36 cuts the rotary dressing grindstone 46 by way of up cut, resulting in an increase in the cutting resistance. Furthermore, since the cutting blade 36 cuts into the rotary dressing grindstone 46 as the cutting blade 36 is moved in the Y-axis direction, the cutting resistance is made higher than if the cutting blade 36 is processing-fed in the X-axis direction. Consequently, the cutting blade 36 is dressed efficiently at all times.

When the diameter of the rotary dressing grindstone 46 is measured as shown in FIG. 4, the solenoid-operated on-off valve 58 is shifted to the closed position to stop the compressed air from being ejected from the sensor case 54 through the opening 54*a*. At this time, the air curtain 67 may be continuously formed by the air curtain forming means 66 or may be interrupted.

In the above embodiment, the optical sensor 56 is supported on the spindle housing 35. However, the optical sensor 56 may be installed in another position rather than on the spindle housing 35. The outer peripheral surface of the rotary dressing grindstone 46 may reflect the applied inspection light beam 62 as regularly reflected light 64 to be detected by the light detector of the optical sensor 56.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cutting apparatus comprising:

a chuck table for holding a workpiece thereon;

cutting means for cutting the workpiece held on said chuck table with a cutting blade mounted on a spindle, while supplying a cutting fluid to said cutting blade;

moving means for moving said spindle to position said cutting blade;

rotary dressing means for rotating a dressing grindstone on a rotational shaft parallel to said spindle; and an optical sensor for detecting the position of the outer periphery of said dressing grindstone, wherein said cutting blade is positioned with respect to said rotary dressing means depending on the position, detected by said optical sensor, of the outer periphery of said dressing grindstone, and said cutting blade is dressed by cutting into said dressing grindstone by a predetermined cutting distance.

2. The cutting apparatus according to claim 1, wherein said optical sensor is positioned to apply an inspection light beam emitted therefrom toward the rotational shaft of said dressing grindstone to the outer peripheral surface of said dressing grindstone, said cutting apparatus further comprises calculating means for calculating the diameter of said dressing grindstone on the basis of light reflected from the outer peripheral surface of said dressing grindstone to which said inspection light beam is applied, and said cutting blade is positioned with respect to said rotary dressing means on the basis of the diameter of the dressing grindstone which is calculated by said calculating means, and said cutting blade is dressed by cutting into said dressing grindstone by said predetermined cutting distance.

3. The cutting apparatus according to claim 1, further comprising:

a casing housing said optical sensor therein, said casing having an opening for passing the inspection light beam emitted from said optical sensor therethrough; and air curtain forming means disposed near said opening, wherein an air curtain formed by said air curtain forming means prevents debris and a cutting fluid from entering said casing through said opening and being applied to said optical sensor.

* * * * *